United States Patent [19]

Brandenburg et al.

[11] Patent Number: 4,543,004

[45] Date of Patent: Sep. 24, 1985

[54] PRINTER HAVING AUTOMATIC PAPER POSITIONING MEANS

[75] Inventors: Klaus Brandenburg, Freudenberg; Wendelin Weber, Siegen, both of Fed. Rep. of Germany

[73] Assignee: U.S. Philips Corporation, New York, N.Y.

[21] Appl. No.: 568,857

[22] Filed: Jan. 6, 1984

[30] Foreign Application Priority Data

Jan. 8, 1983 [DE] Fed. Rep. of Germany ..... 3300458

[51] Int. Cl.[4] ..... B41F 21/04; B41J 11/04

[52] U.S. Cl. ..... 400/649; 400/527.2; 400/624; 400/659; 101/409

[58] Field of Search ..... 400/527.2, 622, 624, 400/649, 659; 101/407 R, 408, 409, 415.1

[56] References Cited

U.S. PATENT DOCUMENTS

| | | | |
|---|---|---|---|
| 1,508,951 | 9/1924 | Baker | 101/409 X |
| 2,056,922 | 10/1936 | Gegenheimer | 101/409 X |
| 2,288,290 | 6/1942 | Marcher | 101/409 |
| 2,865,289 | 12/1958 | Fowlie et al. | 101/409 |
| 3,221,652 | 12/1965 | Mestre | 101/409 X |

FOREIGN PATENT DOCUMENTS

| | | | |
|---|---|---|---|
| 865719 | 3/1941 | France | 101/409 |

OTHER PUBLICATIONS

Barber, Jr. et al.; "Mechanism and Actuator for Clamping Sheets on a Drum", *IBM Technical Disclosure Bulletin*, vol. 23, No. 7A, Dec. 1980, pp. 2679–2682.

*Primary Examiner*—Clifford D. Crowder
*Attorney, Agent, or Firm*—Robert S. Smith

[57] ABSTRACT

A printer has a drum with at least one slot for receiving sheet-like record carriers. The slot extends into the circumference of the drum and is dimensioned to receive clamping means for holding the record carrier with a clamping fit. The control of the clamping means is effected, for example, by means of disks which are secured adjacent the end faces of the drum and whose circumference is also engaged by the clamping means. The disks are provided at their outer side with a first stopper element, which resiliently co-operates with a second stopper element secured to the housing of the device in such a manner that upon rotation of the drum in the printing direction of rotation one stopper element slips over the other and upon rotation of the drum in opposite direction prevent the rotation of the disk. Thus, the clamping means are passed out of the slot. Upon rotation of the drum in the printing direction of rotation, the disks, which are connected to the drum through a tensile spring, are moved in a direction opposite to the printing direction of rotation so that the clamping means are again pressed into the slot.

35 Claims, 5 Drawing Figures

PRINTER HAVING AUTOMATIC PAPER POSITIONING MEANS

Figure 1:
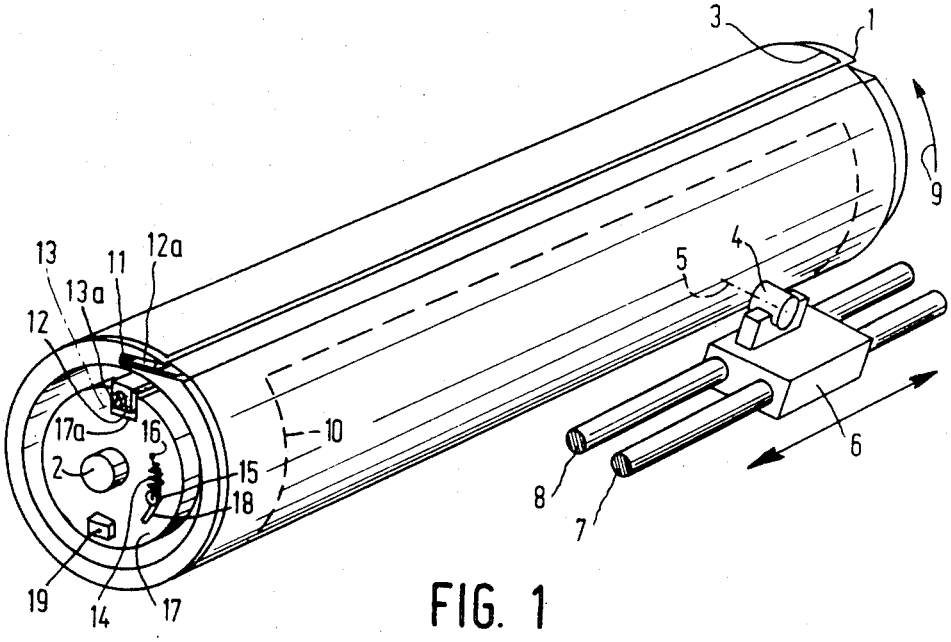

The invention relates to a device for printing a sheet-like record carrier comprising a cylindrical drum which is rotatable about its longitudinal axis and to which clamping means are secured which are rotatable about an axis extending parallel to the drum axis and which upon rotation of the drum in the printing direction of rotation hold the carrier with clamping fit or release it upon rotation of the drum in opposite direction, for which purpose the clamping means are in engagement with control elements and with guiding means for guiding the sheet-like record carrier on the drum.

A device of this kind is already known from French Pat. No. 865,719. As shown in FIG. 6 of the French Patent cam elements 23 are lifted, when the drum is rotated in a direction opposite to the printing direction, by means of fingers 36 secured to a bracket 33 so that they can either receive or release a paper sheet. For this purpose, the bracket 33 has to be manufactured with great accuracy in order to guarantee that all the fingers 36 abut simultaneously against the lever edges of the cam elements 23 when the paper sheet should be released.

The IBM "Technical Disclosure Bulletin", Vol. 23, No. 7A, pages 2679–2682 December 1980 further discloses a device of the aforementioned kind, in which, however, the said cam elements are actuated by a separate drive, which is provided in addition to the normal drive for the movement of the drum. This device is also constructed in a comparatively complicated manner and is very expensive because of the second drive for the cam elements.

The invention has for its object to provide a printer for printing a sheet-like record carrier, which with respect to the known devices has a considerably simpler construction and therefore can be manufactured at low cost.

According to the invention, this is achieved in that the drum has for receiving the carrier at least one slot which extends in the circumferential direction of the drum and into which an end of the clamping means can be inserted, and in that for controlling the clamping means these means engage by their end remote from the slot the circumference of a disk which is rotatable about the drum axis and with respect to the drum and which has at its outer side a first stopper element which follows its rotation and which resiliency cooperates with a second stopper element secured to the housing of the device in such a manner that upon rotation of the drum in the printing direction of rotation one stopper elements slips over the other, while upon rotation of the drum in the opposite direction they prevent the rotation of the disk and a tensile spring arranged between the disk and the drum being stretched.

The drum preferably has a slot which extends throughout the length of the drum.

In a printer thus constructed, the drum is rotated in a direction opposite to the normal printing direction of rotation during printing of a paper sheet until the slot is located opposite the sheet or the sheet edge conveyed by the transport device to the drum (starting position). In this drum position, the clamping means provided for holding the sheet do not project into the slot so that the sheet can be slipped into the slot by means of a transport device. When subsequently the direction of rotation of the drum is reversed, that is to say when it moves in the printing direction of rotation, the clamping means are released and again are in engagement with the slot. They then press the sheet present in the slot against the wall of the slot located opposite to them and thus prevent it from moving. Consequently, upon further rotation in the printing direction of rotation the sheet is fully drawn out of the magazine and wound around the drum, it further being held by the clamping means. If after the printing the sheet should be ejected, the drum is first rotated further in the printing direction of rotation until the drum has reached nearly (but not entirely) its starting position. The drum is then rotated in opposite direction until it reaches the starting position. The sheet is then rolled off the drum so that it can be engaged by sheet extraction rollers. When the starting position of the drum has been reached, the clamping means are removed again and the sheet can be drawn out of the slot and transported to a file by means of the sheet extraction rollers, which are then set into rotation. Subsequently, a new sheet can be inserted into the free slot which is ready for use already. The described process then begins again.

Due to the special arrangement of the clamping means, which are in engagement by their one end with the circumference of the disks already mentioned, a very simple mechanical control of the clamping means in dependence upon the position and the direction of rotation of the drum is reached. The stopper elements are then constructed or arranged so that upon rotation of the drum in the printing direction of rotation both stopper elements slip one over the other. For this purpose, for example, the stopper element present on the disk may be constructed so as to be resilient in axial direction.

However, upon rotation of the drum in opposite direction, the two stopper elements move in opposite directions with respect to each other in such a manner that they are blocked, just like the whole disk. A short further movement of the drum still movable with respect to the disk then ensures that the clamping means are passed out of the slot so that sheets can be inserted or removed. A tensile spring arranged between the disk and the drum is then stretched so that upon rotation of the drum in the printing direction of rotation the clamping means are pressed again into the slot by this resilient force.

Both the clamping means and the disks or the stoppers represent very simple constructional elements, which can be manufactured readily and at low cost and permit of obtaining an inexpensive construction of the printer according to the invention.

The clamping means and the disks are preferably secured to both end faces of the drum. This permits of fixing very simply the disks or the clamping means to the drum.

According to an advantageous further embodiment of the invention, a clamping rail is provided, which is used instead of individual clamping means and which extends throughout the length of the slot. Thus, it is achieved that a sheet to be printed is held uniformly in the slot over its whole stretched length.

According to another advantageous embodiment of the invention, guide plates are arranged as guiding means so as to surround the drum at least in part in the form of a cylindrical sheath. The stretched sheet then extends between these guide plates and the drum or is released by it and at the area at which the sheet is printed, of course slot-shaped apertures are provided in the guide plates, which extend, for example, throughout the length of the drum.

Figure 2:
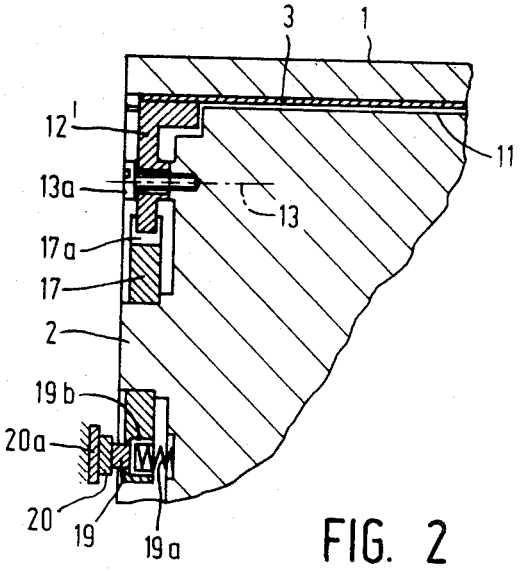
Figure 3:
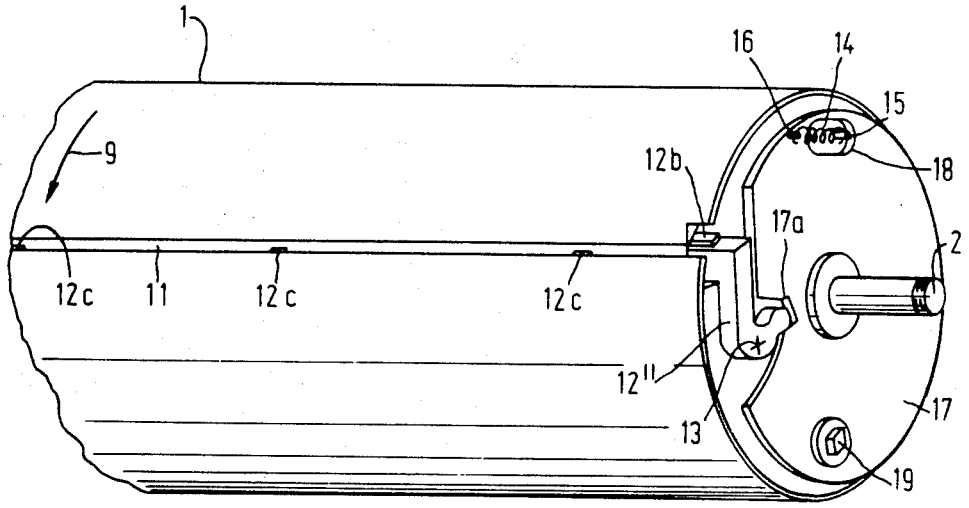
Figure 4:
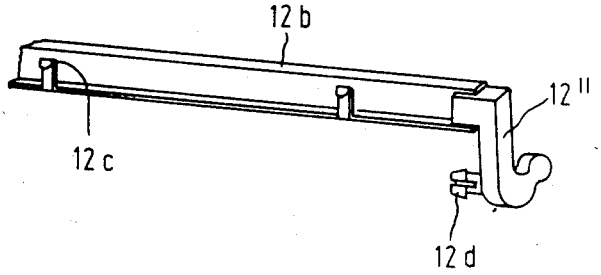
Figure 5:
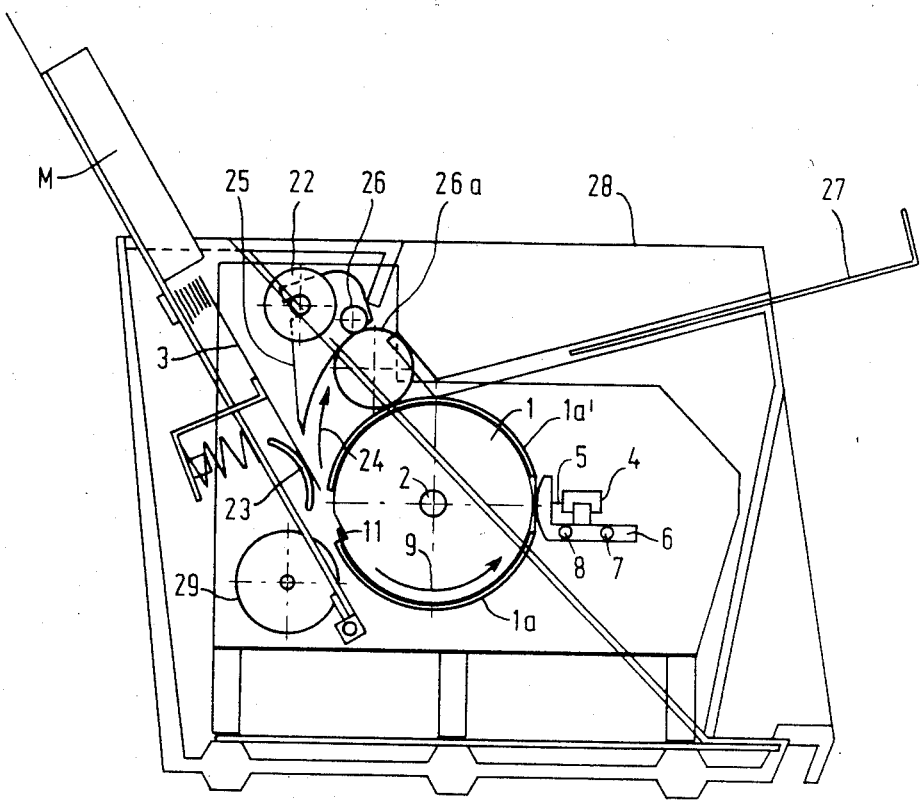

In order that the invention may be readily carried out, it will now be described more fully, by way of example, with reference to the accompanying drawing, in which:

FIG. 1 is a perspective view of a cylindrical drum with a slot extending throughout the length of the drum, FIG. 2 is an axial sectional view of the drum shown in FIG. 1 with a modified clamping means, FIG. 3 is a perspective view of a cylindrical drum with a clamping rail, FIG. 4 is a more accurate representation of the clamping rail shown in FIG. 3, and FIG. 5 is a side elevation of a device according to the invention.

The cylindrical drum 1 shown in FIG. 1, which is arranged so as to be rotatable about its longitudinal axis 2 (cylinder axis) is, for example, the drum of a conventional mechanical printer. On the surface of the drum 1 there is arranged a sheet 3 to be printed, for example, a paper form, whose extent in the direction of the longitudinal axis 2 substantially corresponds to the extent of the drum and in the direction of the circumference of the drum substantially corresponds to the circumference of the drum 1. For printing the sheet 3 provision is made of a printing head 4 with, for example, only one printing needle 5 which is arranged on a carriage 6, which can be guided by means of a guiding rod 7 extending parallel to the longitudinal axis 2 and can be displaced by a rotatable shaft 8 extending parallel thereto. During the normal printing process, the drum 1 rotates in the printing direction of rotation 9. A given printing range 10, which defines, for example, the size of a writing field, is then scanned by the printing head 4.

The drum 1 has a slot 11 which extends throughout its length is located in its interior and parallel to the longitudinal axis 2 and is arranged at right angles to the longitudinal axis 2 at least approximately in the direction of the circumference of the drum. The sheet 3 is inserted by its upper edge into this slot 11. The slot extends at such an inclination in the interior of the drum 1 that the sheet 3 is prevented from bending in the upper range.

The sheet 3 is held in the slot 11 by means of clamping means 12, which are secured to the two end faces of the drum 1 and are rotatable about a clamping means axis 13 rigidly connected to the drum 1 and extending parallel to the longitudinal axis 2. The clamping means ends 12*a* engage in the position shown in FIG. 1 the slot 11 and consequently hold the sheet 3 therein. The clamping means 12 are pressed against the sheet 3 by means of the force of a tensile spring 14, which spring is stretched between two bolts 15 and 16. The resilient force is then transferred by means of a disk 17 rotatable about the longitudinal axis 2 and with respect to the drum 1 to the clamping means 12 which engage by their end remote from the slot 11 the circumference of the disk 17 or a corresponding radial groove 17*a*, which is slightly larger than the relevant end of a clamping means. The bolt 16 is rigidly connected to the drum 11 on the disk 17 and on the bolt 15 through an aperture 18 in the disk 17 so that the force of the spring 14 acts upon the clamping means 12 through the disk 17.

The disk 17 further carries a first stopper element 19 which follows the rotation of the disk 17 and is arranged resiliently in the direction of the axis 2. It is bevelled at its end face and is in engagement with a corresponding second stopper element (20 in FIG. 2), which is fixedly secured to the housing of the printer. This second stopper element 20 is bevelled, just like the first stopper element 19, at its end face facing the drum, but is rotated with respect to this first stopper element through 180°. When therefore the drum 1 is moved in the printing direction of rotation 9, the position of the sheets 3 is not changed at all. The second stopper element 20 connected to the housing at the area of the first stopper element 19 is covered solely by the first stopper element 19 and does not prevent the drum from moving. Each time after the first stopper element 19 has covered the second stopper element 20, this second stopper element springs back solely axially into its starting position. The clamping means 12 consequently hold the sheet 3 in the slot 11 so that it is taken along by the drum 1 when the drum moves in the direction of the arrow 9. Of course the second stopper element 20 may alternatively be arranged resiliently and the first stopper element may be arranged fixedly.

The clamping means 12 may additionally be provided on their side engaging the sheet 3 with a tip, for example of metal, so that the sheet 3 is held even more firmly. The tip may be, for example, that of a pin which penetrates the clamping means 12.

When the drum 1 is rotated in the direction opposite to the printing direction of rotation 9, the first stopper element 19 engages by its edge the second stopper element 20 secured to the housing of the printer. First the disk 17 is then stopped. However, the drum still continues to rotate over a small distance, i.e. until the end of the clamping means 12 projecting into the circumference of the disk 17 also prevents the movement of the drum 1. The groove 17*a*, viewed in the circumferential direction of the disk 17, is then wider than is a clamping means 12 because the latter has to be passed out of the slot 11 by a rotational movement about the clamping means axis 13. The additional rotation of the drum 1 is therefore sufficient to press the clamping means 12 taken along by it against the disk 17 by its end remote from the slot 11 so that due to the lever action the clamping means 12, which may be, for example, of angular cross-section, are rotated about the clamping means axis 13 out of the slot 11. The sheet 3 is consequently held no longer by these means and can now be pulled out of the slot 11 or off the drum 1. This position of the drum 1 will be designated hereinafter as the starting position.

The clamping means 12 therefore serve to stop the drum 1 when the disk 17 is already stationary. This may additionally also be achieved by means of the bolt 15 and the aperture 18. As a result, it is avoided that the clamping means 12, when the disk 17 is already stationary, abut too strongly against the edge of the groove 17*a* and only then causes the drum 1 to be stopped. The bolt 15 additionally also serves to axially lock the disk 17 against displacement because it is provided with a head which projects beyond the width of the slot of the aperture 18.

FIG. 2 is an axial partial sectional view of the cylindrical drum shown in FIG. 1. The sectional view passes both through the clamping means and through the stopper elements.

The clamping means 12' in this case, in contrast with FIG. 1, is rectangularly bent in the direction of the cylinder axis 2 in order to ensure that the sheet 3 is clamped more firmly. This element is rigidly connected to the drum body 1 by means of a screw 13*a*, about which it can be moved freely. On the other hand, it engages the aforementioned groove 17*a* of the control disk 17 by its end remote from the slot 11. This control disk 17 has rigidly connected to it the first stopper element 19, which is resiliently journalled in the direction of the cylinder axis 2. For this purpose, provision is made of a compression spring 19*a* which is journalled on the one hand by a rear recess 19*b* in the control disk 17 and on the other hand by the drum body 1. This does not give rise to problems because the relative movement between the control disk 17 and the drum body 1 is only very small and is performed only to set the clamping means into motion. The second stopper element 20 is rigidly connected to a part 20*a* of the housing of the printer. Both stopper elements 19 and 20 have ramps which face each other and are inclined so that the stopper elements 19, 20 slip one over the other upon rotation of the drum 1 in the printing direction of rotation in that, for example, the stopper element 19 is axially pressed inwards. When the drum 1 is rotated in a direction opposite to the printing direction of rotation, these stopper elements definitely engage each other and prevent further movement of the control disk 17.

FIG. 3 is a perspective view of a further drum of a printer according to the invention. In this case also, like parts are designated by like reference symbols. This drum 1 has at its both ends a control disk 17, only one of these disks being represented. There is arranged between the clamping means 12" a clamping rail 12*b* of U-shaped profile, which engages the clamping means 12" with clamping fit. The clamping rail 12*b* is shown more precisely in FIG. 4. It is arranged over its whole length within the drum 1 and has resilient tongues 12*c*, which upon rotation of the drum 1 in the printing direction of rotation press a sheet to be printed against the wall of the slot 11 provided inside the drum 1. The resilient tongues 12*c* can then be distributed uniformly over the length of the clamping rail 12*b*. The clamping elements 12" are provided, for example, with expanding mandrels which, in order to be secured to the drum 1, can be inserted into a suitably shaped bore at the end face of the drum. For example, this bore may be provided in an additional plate firmly engaging the end face of the drum.

The drum 1 set to the starting position may receive in a simple manner sheet-like record carriers. This will be explained more fully with reference to FIG. 5, which practically shows a side elevation of the device according to the invention. The drum 1 shown in this Figure is in its starting position, that is to say the slot 11 is positioned so that a sheet 3 passed out of a cassette M by means of a sheet-feeding roller 22 (transport device) and guided over a guide plate 23 can be directly introduced into the slot 11. In the starting position, which is characterized by the engagement of the first stopper element 19 by the second stopper element 20, moreover, as already stated, the clamping means 12 are rotated out of the slot 11.

Consequently, in the starting position of the drum shown in FIG. 2, the sheet 3 can be directly introduced into the slot 11, which is also effected by means of the sheet-feeding roller 22. When subsequently the drum 1 is rotated in the printing direction of rotation 9, the clamping means 12 engage the slot 11, as already described with reference to FIG. 1, and hold the sheet 3 so that it is wound around the drum 1.

In order to guide the sheet 3 more accurately, guide plates 1*a*, 1*a*' can be provided which guide plates extend around the drum 1 in the form of a cylindrical sheath. Solely in the sheet-feeding range and in the printing range, slot-shaped apertures are provided whose length corresponds to the length of the drum. The sheet 3 may also be guided in a different manner, for example by rollers distributed over the circumference of the drum.

When the sheet 3, whose width corresponds, for example, to the length of the circumference of the drum 1, is ejected, the drum 1 is rotated further after the termination of the printing process in the direction of rotation 9 nearly into the starting position. As a result, the sheet end, i.e. the terminal edge located opposite to the stretched sheet edge, is positioned again at the area of the slot-shaped aperture for introducing the sheet between the guide plates 1*a*, 1*a*'. Moreover, the first stopper element 19 is then not yet stopped by the second stopper element 20 so that subsequently the drum 1 can be rotated in a direction opposite to the printing direction of rotation 9 into the starting position (stopping of the first stopper element 19 by the second stopper element 20). In this position, the clamping means 12 then release the sheet 3.

When the drum 1 is rotated in a direction opposite to the direction 9, the sheet 3, whose terminal edge was located between the guide plates 1*a* and 1*a*', is simultaneously rolled off the drum 1 and is moved in the direction of the arrow 24. It is then guided by a further guide plate 25 between two sheet extraction rollers 26 and 26*a*. When the drum 1 has reached the starting position and when the sheet has thus been released by the clamping means 12, these sheet-extraction rollers convey the sheet 3 into a filing compartment 27 which projects from the housing 28 of the printer for facilitating the removal of the sheet.

Both the movements of the drum 1 and of the printing head 4 and the movements of the sheet-feeding and sheet-extraction rollers can be effected by means of a motor 29. The course of the movement can be controlled via suitable mechanical and/or electrical switching devices.

Essentially, the invention relates to all printers comprising a rotating drum 1 and is not limited to the needle-head printer described in the embodiment.

What is claimed is:

1. A device for printing a sheet-like record carrier comprising a cylindrical drum which is rotatable about its longitudinal axis and to which clamping means are secured which are rotatable about an axis extending parallel to the drum axis and which upon rotation of the drum in the printing direction of rotation hold the carrier and release the carrier upon rotation of said drum in the opposite direction, for which purpose the clamping means are in engagement with control elements and with guiding means for guiding the sheet-like record carrier on said drum, said drum having a slot dimensioned for receiving the carrier which extends into the circumference of said drum, said device including clamping means having first and second ends, said slot being dimensioned and configured for engagement with said first end of said clamping means, said device including a disk, said second end of said clamping means engaging the circumference of said disc, said disc being rotatable about the axis of said drum and with respect to said drum and which carries on its outer side a first stopper element which follows its rotation and which resiliently cooperates with a second fixed stopper element secured to a housing of the device in such a manner that upon rotation of the drum in the printing direction of rotation one of said stopper elements slips over the other, and upon rotation of said drum in the opposite direction said stopper elements preventing rotation of said disc, said device including a tensile spring which is arranged between said disk and said drum, said tensile spring being stretched when said drum is rotated in the opposite direction.

2. A device as claimed in claim 1, wherein said slot extends throughout the length of said drum.

3. A device as claimed in claim 2, characterized in that the clamping means and the disks are secured adjacent the two end faces of said drum.

4. A device as claimed in claim 3, wherein said clamping means comprises a single clamping rail which extends throughout the length of the slot.

5. A device as claimed in claim 4, wherein said clamping means are provided at their side facing the carrier with resilient tongues for more firmly holding the carrier.

6. A device as claimed in claim 5, characterized in that the first stopper element is constructed so as to be resilient in a direction parallel to the axis of said drum.

7. A device as claimed in claim 4, characterized in that the guiding means comprise guide plates surrounding the drum at least in part in the form of a cylindrical sheath.

8. A device as claimed in claim 4, characterized in that the first stopper element is constructed so as to be resilient in a direction parallel to the axis of said drum.

9. A device as claimed in claim 3, wherein said clamping means are provided at their side facing the carrier with resilient tongues for more firmly holding the carrier.

10. A device as claimed in claim 9, characterized in that the first stopper element is constructed so as to be resilient in axial direction.

11. A device as claimed in claim 9, characterized in that the first stopper element is constructed so as to be resilient in a direction parallel to the axis of said drum.

12. A device as claimed in claim 3, characterized in that the guiding means comprise guide plates surrounding the drum at least in part in the form of a cylindrical sheath.

13. A device as claimed in claim 3, characterized in that the first stopper element is constructed so as to be resilient in a direction parallel to the axis of said drum.

14. A device as claimed in claim 2, wherein said clamping means comprises a single clamping rail which extends throughout the length of said slot.

15. A device as claimed in claim 14, wherein said clamping means are provided at their side facing the carrier with resilient tongues for more firmly holding the carrier.

16. A device as claimed in claim 15, characterized in that the first stopper element is constructed so as to be resilient in axial direction.

17. A device as claimed in claim 15, characterized in that the first stopper element is constructed so as to be resilient in a direction parallel to the axis of said drum.

18. A device as claimed in claim 14, characterized in that the guiding means comprise guide plates surrounding the drum at least in part in the form of a cylindrical sheath.

19. A device as claimed in claim 14, characterized in that the first stopper element is constructed so as to be resilient in a direction parallel to the axis of said drum.

20. A device as claimed in claim 2, wherein said clamping means are provided at their side facing the carrier with resilient tongues for more firmly holding the carrier.

21. A device as claimed in claim 20, characterized in that the first stopper element is constructed so as to be resilient in a direction parallel to the axis of said drum.

22. A device as claimed in claim 2, characterized in that the first stopper element is constructed so as to be resilient in a direction parallel to the axis of said drum.

23. A device as claimed in claim 1, characterized in that the clamping means and the disks are secured adjacent the two end faces of said drum.

24. A device as claimed in claim 23, wherein said clamping means comprises a single clamping rail which extends throughout the length of said the slot.

25. A device as claimed in claim 24, wherein said clamping means are provided at their side facing the carrier with resilient tongues for more firmly holding the carrier.

26. A device as claimed in claim 25, characterized in that the first stopper element is constructed so as to be resilient in axial direction.

27. A device as claimed in claim 25, characterized in that the first stopper element is constructed so as to be resilient in a direction parallel to the axis of said drum.

28. A device as claimed in claim 24, characterized in that the guiding means comprise guide plates surrounding the drum at least in part in the form of a cylindrical sheath.

29. A device as claimed in claim 24, characterized in that the first stopper element is constructed so as to be resilient in a direction parallel to the axis of said drum.

30. A device as claimed in claim 23, wherein said clamping means are provided at their side facing the carrier with resilient tongues for more firmly holding the carrier.

31. A device as claimed in claim 30, characterized in that the first stopper element is constructed so as to be resilient in a direction parallel to the axis of said drum.

32. A device as claimed in claim 23, characterized in that the first stopper element is constructed so as to be resilient in a direction parallel to the axis of said drum.

33. A device as claimed in claim 1, wherein said clamping means are provided at their side facing the carrier with resilient tongues for more firmly holding the carrier.

34. A device as claimed in claim 33, characterized in that the first stopper element is constructed so as to be resilient in a direction parallel to the axis of said drum.

35. A device as claimed in claim 1, characterized in that the first stopper element is constructed so as to be resilient in a direction parallel to the axis of said drum.

* * * * *